United States Patent [19]

Kollar et al.

[11] 4,096,674

[45] Jun. 27, 1978

[54] FALSE TENON STRUCTURE

[76] Inventors: Ernest Paul Kollar; Julie Ann Kollar, both of Rte. 1, Box 221-B3, Longmont, Colo. 80501

[21] Appl. No.: 827,995

[22] Filed: Aug. 26, 1977

[51] Int. Cl.[2] ..... E04B 1/10

[52] U.S. Cl. ..... 52/233; 46/20

[58] Field of Search ..... 52/233, 311, 313; 46/20

[56] References Cited

U.S. PATENT DOCUMENTS

| | | | |
|---|---|---|---|
| 1,510,326 | 9/1924 | Locke | 52/233 |
| 1,758,046 | 5/1930 | Ilson | 52/233 |
| 2,005,921 | 6/1935 | Reither | 52/233 |
| 2,110,787 | 3/1938 | Brandjord | 52/233 |
| 4,056,906 | 11/1977 | Elfström | 52/233 |

*Primary Examiner*—Ernest R. Purser

*Assistant Examiner*—Henry Raduazo

*Attorney, Agent, or Firm*—O'Rourke & Harris

[57] ABSTRACT

A false tenon structure for use in "split log" structures of various cross-sectional configurations, the tenon being of the appropriate cross-section and having at an end a cradle shaped to accept an adjacent tenon in an end portion thereof and transversely therethrough, and planar interfacing surfaces at the end thereof with one of the interfacing surfaces defining a projection such that left hand and right hand, i.e., mirror image alternatives, of the tenon may be stacked with one tenon in the cradle of the adjacent tenon and, secured to a building corner by fasteners driven through the projection, and abutted against split log facades to present a realistic appearance of conventional full log mortise and tenon structures, or of stacked members of other cross-sections.

8 Claims, 5 Drawing Figures

FALSE TENON STRUCTURE

BACKGROUND OF THE INVENTION

1. Field of the Invention

The present invention relates generally to split log structures having the appearance of full log mortise and tenon structures, or other stacked member construction, and more particularly to a false tenon which is attachable to the corner structure of a conventional building having a facade thereon to present the appearance of a classic full log or other stacked member structure.

2. Description of Prior Art

Classically, log structures have been formed of full, round logs having notches in the ends thereof which interconnect at the corners thereof. The notches are therein referred to as mortises and the log extending through the notches, as well as the overhanging portion of the log extending past the corner portion, are referred to as tenons. While log structures, particularly full log structures, are quite popular for the appealing rustic appearance presented, in fact, modern building methods have been found to be superior in structural integrity, insulation and other such desirable characteristics.

The classical mortise and tenon structure was convenient for simplicity in the event of minimal tools and energy, but again more modern tongue and groove shapes now available with more sophisticated wood shaping equipment has provided for improved structure even when full logs are used. For instance, in U.S. Letters Pat. No. 2,005,921, there is disclosed a full log structure with longitudinal tongue and groove and more modern interconnection at the corners. However, though of no structural function, a false tenon is provided to maintain the classic mortise and tenon structure appearance.

An even more desirable structure is one in which a conventional wall, i.e., stud wall with, for instance, plywood sheathing is formed and half log or split log facade applied to the exterior and/or interior of the walls to provide a "log structure" appearance. This approach, in large part, combines the functional advantages of modern construction with the classical appearance of a rustic log structure. However, heretofore, half log or split log structures, either the stackable type, disclosed in, for instance, U.S. Letters Pat. Nos. 1,501,326 and 1,655,701, or the facade applied to conventional walls, as in U.S. Letters Pat. No. 4,012,876, have lacked the appearance of a true, classical mortise and tenon full log structure. The half log members, even when formed in a mortise and tenon fashion at the corners presented but a half log exposure. Other approaches, such as the vertical log in U.S. Letters Pat No. 1,665,701 have also been suggested. In general, the split log facade on a conventional wall appeared at the corners to be just that, i.e., a veneer or facade.

SUMMARY OF THE INVENTION

The present invention, which provides a heretofore unavailable improvement over previous split log structures, comprises an interface between the facade and false corner structure, and more particularly, false tenon which provides an accurate representation and appearance of a classical, full rounded log or other full structure. The structure of the instant invention primarily concerns a false tenon or overhang or overhang portion of a log in the form of a full member of a shape suggested by the facade or "split" members having at an end thereof a saddle, angular planar surfaces configured to abut against a conventional wall corner, and a projection, or tongue member, through which fasteners may be placed to secure the false tenon to a conventional wall. By forming the false tenon in left and right hand versions, i.e., mirror image versions, and stacking these false tenons vertically at the corner of a conventional wall, it is possible, by properly forming the ends of the split log facade, to provide a most realistic appearing, pseudoclassical full log, or other structure while maintaining all the advantages of modern construction.

Accordingly, it is an object of the present invention to provide a new and improved split log structure which realistically portrays a classical, full log mortise and tenon log structure.

Another object of the present invention is to provide a new and improved structure which, while appearing to be a full member structure, is in fact a facade structure.

Yet another object of the present invention is to provide a new and improved log structure which concurrently provides the advantages of modern construction with regard to cost, insulation, structural integrity while maintaining the appearance of full log, classical mortise and tenon struction.

Still another object of the present invention is to provide a new and improved structure which provides at the overlapping tenon portion, the appearance of a full member of a predetermined cross-section while, in the main portion of the structure, using a facade arrangement.

These and other objects and features of the present invention will become apparent from the following description.

DETAILED DESCRIPTION OF THE INVENTION

While the following discussion will primarily relate to the relationship between a split log facade and a full log false tenon to present the appearance of the classical full log mortise and tenon construction; it is to be understood that the apparent cross-section may vary substantially, i.e., square "logs" may be portrayed. In such an instance, the facade would be in the form of relatively thin rectangular members, while the false tenon would in fact be square. Other cross-sections can also be represented.

Similarly, though the facade is recited as being "split", in fact planing or other forming steps are more generally employed to form a member having the split log characteristic. It is contemplated that materials other than wood, i.e., skinned polymeric foams can be employed to form the "logs".

Figure 1:
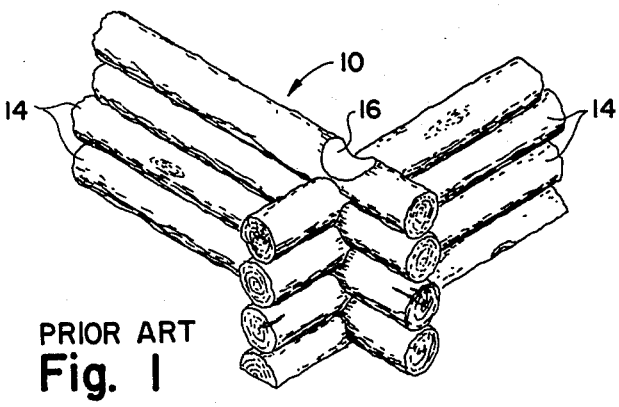
PRIOR ART Fig. 1
FIG. 1 is a perspective view of a portion of a classical, full log mortise and tenon log structure.

Turning now to the drawings, wherein the classical structure is specifically illustrated and wherein like components are designated by like numerals throughout the various figures, a classical log structure 10 is shown in FIG. 1. The most desirable appearance of the classical picture 10 is provided as a result of the interlocking at the bottom portion, of an initial half log 12, and thereafter a series of full logs 14 having at the end portions thereof mortise 16 defined with tenons 18 extending therethrough. As will be apparent, each log has both the mortise 16 and, a tenon portion 18. For purposes of this discussion, the portion of each log 14 extending beyond the intersection with interlocking logs will be referred to as the tenon 18, or overhang portion.

Figure 2:
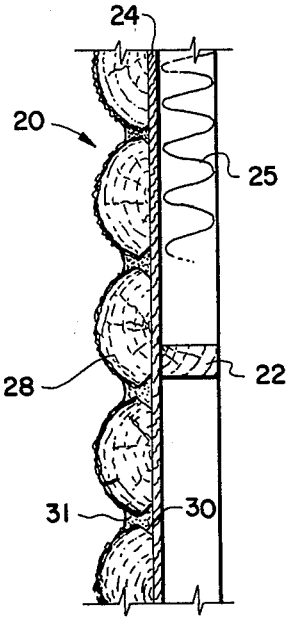
FIG. 2 is a sectional side view of a wall of conventional construction having thereon the split log facade of the present invention.

While the classical structure 10 of FIG. 1 presents an attractive and desirable rustic appearance, a more economical and functional structure is illustrated in FIG. 2. Conventional wall 20 is formed, typically, by studs 22, normally vertical but illustrated horizontally for simplicity, carrying thereon sheathing 24 of plywood, pressed board or other such material and having, as is conventional, insulation 25 disposed within the wall. On the exterior of sheathing 24, split logs 28 are fastened by, for instance, glues, nails, or other fasteners (not shown). It should be noted that split logs 28 or other facade shapes are generally of a nominal radius "*r*" or other cross-sections largely consistent between split logs 28, and of a thickness "*t*", again substantially consistent between individual split logs 28. Bevels 30 may be provided at the interface of the planar portions of the split logs 28 and sheathing 24 to engage and retain chinking material 31 which may be a mortar, a caulking compound, or other filler.

As will be apparent, the surface appearance of conventional wall 20 is quite similar to the general appearance of the interface between logs 14 of classical structure 10. Facade members of other cross-sections can similarly present a desired appearance. However, at the intersections of walls 20, the appearance will differ radically from that desired in that split logs 28 do not present a true representation of tenons 18, or other full members.

Figure 3:
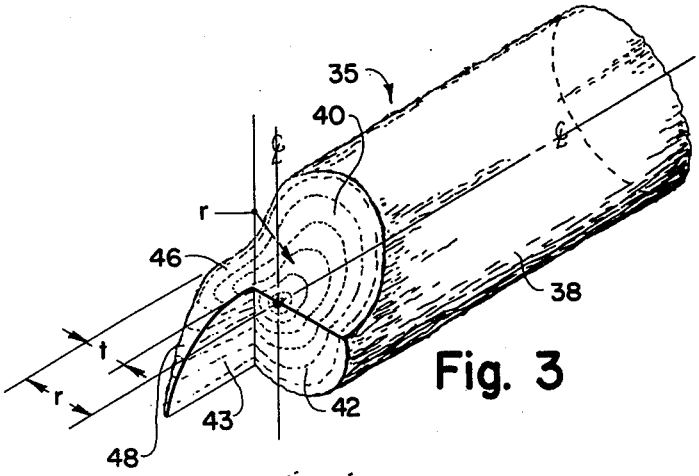
FIG. 3 is a perspective view of a full log false tenon in accord with the present invention.

As shown in FIG. 3, in the case of the classical log structure facade, false tenon 35 of the instant invention may be utilized to accurately reproduce the tenon appearance of classical wall 10. False tenon 35 is basically formed of a section of cylindrical log 38, having a radius "*r*" similar to that of nominal radius "*r*" of split logs 28. A partial cradle 40 is defined in the upper half of log 38. Partial cradle 40 is, generally, of a cylindrical configuration with the axis thereof parallel to the direction of the course of split logs 28 forming the subject corner, and roughly quarter cylindrical in extent. The bottom portion of partial cradle 40 is generally tangent to a horizontal plane through the center of log 38. If other than a round configuration is desired, cradle 40 would conform to the next adjacent tenon, i.e., of a complementary shape.

A first planar surface 42 is defined in a direction substantially parallel to the axis of cradle 40. Planar surface 42 extends from one edge of log 38, along the face defined and intersects with second planar surface 43, which extends in a direction parallel to the other course of split logs 28 defining the corner. Second planar surface 43 defines, in part, projection 46 which is of a maximum thickness "*t*" equivalent to the thickness of split log 28. Finally, projection 46 is further defined by curved surface 48, which is substantially cylindrical and having a radius "*r*" in the preferred instance, or again of the cross-sectional shape of the adjacent tenon for other than round tenons. Accordingly, the rather involved configuration of false tenon 35, in the case of a right angle corner, involves first and second planar surfaces 42 and 43 forming a right angle configuration with projection 46 arranged to receive glue or fasteners (not shown) for attachment to the corner of conventional wall 20.

Figure 4:
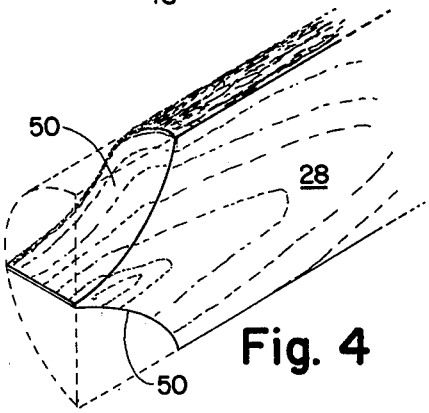
FIG. 4 is a perspective view illustrating the end section of the split log facade with the removed portion shown in ghosted manner.

Finally, it is necessary that split logs 28 be configured at the end portion thereof as shown in FIG. 4. More specifically, split log 28 has defined at the ends thereof symmetrical curved surfaces 50 substantially of radius "*r*" for round false tenons 35, or shaped to fit surface 48 and the exterior of false tenon 35 in general.

Figure 5:
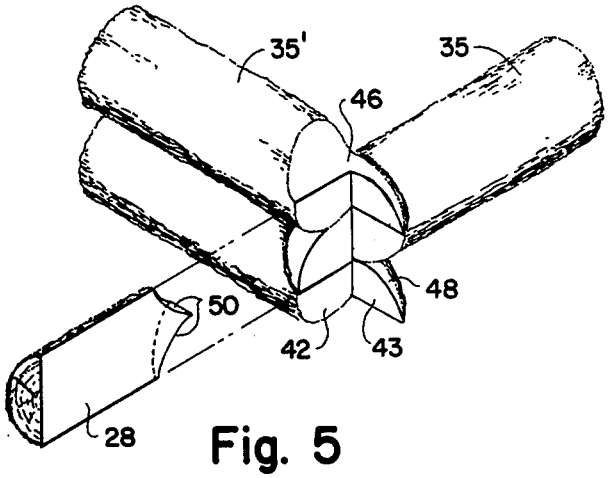
FIG. 5 is a perspective, partially exploded view of the false tenon structure of the present invention illustrating also the interface of the split log facade therewith.

In practice, false tenons 35 are formed in right hand and left hand versions with the left hand version referred to as 35'. The right hand and left hand versions are merely the configuration as shown in FIG. 3 and mirror images thereof. Thus false tenon 35 and false tenon 35' may be stacked, as shown in FIG. 5, with first and second planar surfaces 42 and 43 forming a continuous flat surface adapted for securing to the corner portion of conventional wall 20, and more specifically to the angular intersection of sheathing 24. Nails, or other fasteners (not shown), may be conveniently driven through projection 46 into the adjacent sheathing 24 to secure false tenons 35 and 35' to the sheathing, or glue may be used for attachment. For convenience, tenons 35 and 35' are stacked in a manner inverted from that shown in FIG. 5 to expose projection 46 for nailing. For purposes of illustration, the arrangement of FIG. 5 better displays the various planes, curves and interfaces, and also depicts an alternate, but not preferred, workable arrangement.

Surfaces 50 of split logs 28 intersect with the surface of tenon 35 adjacent planar surface 42 at one part, and curved surface 48 of tenon 35, as again is shown in FIG. 5. The perspective shown in FIG. 5 is that of a wall to which false tenons 35 and 35' as well as split log 28 are secured. However, it will be recognized that from the opposite side, the members present an accurate representation of the structure of classical structure 10 shown in FIG. 1 with split logs 28 presenting the appearance of logs 14 along the length thereof, and false tenons 35 and 35' interfacing with split logs 28 to provide a classic mortise and tenon appearance.

If the facade is intended to represent other than rounded logs, surfaces 40 and 48 and 50 are merely configured to interface with the desired cross-section. The false tenon of course is formed in the desired cross-section, i.e., square, round, rectangular, curvelinear, etc.

Summarily, the instant invention involves a means for providing the appearance of a stacked member structure, such as a log building, by attaching elongated members over a conventional building to form a facade and, by also utilizing the unique false tenon, presenting the image of a mortise and tenon overlapping, interlocking structure at the corners thereof. The false tenon, which is particularly adaptable to portraying classical full log structures, can be utilized with stacked members of varying cross-sectional configurations provided the cross-section is substantially constant throughout the various members. The facade and/or false tenon may be made from natural materials, i.e. wooden logs, or from synthetics such as polymers, foams, etc, representing the natural material.

Although but limited embodiments of the present invention have been illustrated and described, it is anticipated that numerous changes and modifications will be apparent to those skilled in the art, and that such changes may be made without departing from the invention as defined by the following claims.

What is claimed is:

1. A false tenon for use at the intersection of first and second planar structural surfaces which meet at a given angle with each of the structural surfaces having thereon facade members of a thickness "*t*" representing stacked members of a predetermined cross-section, the false tenon comprising;

an elongated member of the full, predetermined cross-section configuration;

a cradle of a shape adapted to receive the predetermined cross-section defined around a cradle axis transversely through and adjacent to one end of the elongated members;

a first tenon planar surface adapted to interface with the first planar structural surface defined at the end of the false tenon and intersecting the surface defining the cradle at a line parallel to the cradle axis; and a projection having a thickness of "*t*" extending from the end of the elongated member substantially in the direction of the elongated member and defined by a second tenon planar surface adapted to interface with the second planar structural surface which intersects the first tenon planar surface at an angle substantially that of the given angle of the intersection of the planar structural surfaces and at a line substantially perpendicular to the line of intersection of the first tenon planar surface and the cradle surface, a surface extending as a continuation of the cradle surface and having a configuration substantially that of a portion of the predetermined cross-section, and the surface of the elongated member;

whereby false tenons may be stacked with alternating false tenons formed in mirror image fashion to provide the appearance of full predetermined cross-section stacked members.

2. A false tenon as set forth in claim 1 in which the elongated member is of a circular cross-sectional configuration and the cradle is defined by a cylindrical surface having an axis parallel to the first tenon planar surface.

3. A false tenon as set forth in claim 2 in which the false tenon members are stacked with adjacent tenons interfacing with a facade member at arcuate surfaces defined symmetrically at the end portion of the facade member.

4. A false tenon as set forth in claim 1 in which the predetermined angle between the structural surfaces is a right angle and the first tenon planar surface and second tenon planar surface intersect at a right angle.

5. A false tenon as set forth in claim 1 in which the elongated member is formed of a wooden log substantially of circular cross-section.

6. A facade construction comprising;

first and second structural surfaces intersecting at a given angle;

a plurality of false tenons formed of elongated members of a predetermined cross-sectional configuration, each tenon having a cradle of a configuration adapted to receive the predetermined cross-section defined transversely through and adjacent to one end of the elongated member, a first tenon planar surface adapted to interface with the first structural surface defined at the end of the false tenon and intersecting the surface defining the cradle at a line parallel to the cradle axis;

a projection having a thickness "*t*" extending from the end of the elongated member substantially in the direction of the length of the elongated member and defined by a second tenon planar surface adapted to interface with the second structural surface and which intersects the first tenon planar surface at an angle substantially that of the given angle of intersection of the structural surfaces and at a line perpendicular to the line of intersection of the first tenon planar surface and the cradle surface, a second surface extending as a continuation of the cradle surface and having a configuration substantially that of a portion of the predetermined cross-section, and the surface of the elongated member, the false tenons being formed in mirror image fashion and stacked in alternating arrangement with the first and second tenon planar surfaces aligned and interfacing with structural surfaces;

means attaching the stacked false tenons to the structural surface; and a plurality of facade members of a thickness "*t*" and having a surface forming a portion of the predetermined cross-section attached to the structural surfaces and closely interfacing the stacked false tenons at the ends thereof.

7. A structure as set forth in claim 6 in which the predetermined cross-section is circular, elongated members are circular logs, and the cradles are a portion of cylindrical surface.

8. A structure as set forth in claim 7 in which the facade members are cylindrical at the exposed surface and attached to the structural wall at a flat surface, the facade members having arcuate surfaces formed around the centerline thereof at the portions of the facade members interfacing with the stacked false tenons.

* * * * *